US008337638B2

(12) United States Patent
Oishi et al.

(10) Patent No.: US 8,337,638 B2
(45) Date of Patent: Dec. 25, 2012

(54) POWDER FOR DUST CORE AND METHOD FOR PRODUCING THE SAME

(75) Inventors: Yusuke Oishi, Nagoya (JP); Eisuke Hoshina, Toyota (JP); Toshiya Yamaguchi, Miyoshi (JP); Kazuhiro Kawashima, Kasugai (JP)

(73) Assignees: Toyota Jidosha Kabushiki Kaisha, Aichi (JP); Fine Sinter Co., Ltd, Aichi (JP)

( * ) Notice: Subject to any disclaimer, the term of this patent is extended or adjusted under 35 U.S.C. 154(b) by 168 days.

(21) Appl. No.: 12/988,286

(22) PCT Filed: Apr. 17, 2009

(86) PCT No.: PCT/JP2009/057728
§ 371 (c)(1),
(2), (4) Date: Oct. 15, 2010

(87) PCT Pub. No.: WO2009/128524
PCT Pub. Date: Oct. 22, 2009

(65) Prior Publication Data

US 2011/0024000 A1 Feb. 3, 2011

(30) Foreign Application Priority Data

Apr. 18, 2008 (JP) ..... 2008-109252

(51) Int. Cl.
*H01F 1/147* (2006.01)
*H01F 1/20* (2006.01)

(52) U.S. Cl. ..... 148/122; 148/105; 148/113; 148/306

(58) Field of Classification Search ..... None
See application file for complete search history.

(56) References Cited

U.S. PATENT DOCUMENTS

2003/0177867 A1* 9/2003 Hultman et al. ..... 75/349
2005/0217762 A1* 10/2005 Choi et al. ..... 148/113

FOREIGN PATENT DOCUMENTS

JP 02-097603 A 4/1990
JP 11-087123 A 3/1999
JP 2005-060830 A 3/2005
JP 2005-187918 A 7/2005
JP 2007-123703 * 5/2007
JP 2007-126696 A 5/2007
JP 2009-123774 A 6/2009

OTHER PUBLICATIONS

International Search Report for PCT/JP2009/057728, dated Jul. 14, 2009.

* cited by examiner

*Primary Examiner* — John Sheehan
(74) *Attorney, Agent, or Firm* — Sughrue Mion, PLLC

(57) ABSTRACT

A powder for a dust core comprising a silicon-containing layer formed within a depth of less than 0.15 D from the surface of the surface layer of a soft magnetic metal powder having a particle diameter D and a method for producing the same are provided. The method for producing a powder for a dust core 10 comprising a silicon-containing layer 2 comprises performing silicon impregnation of the surface of a soft magnetic metal powder (particle) 1 containing a carbon element, wherein:

silicon impregnation is performed by bringing a powder for silicon impregnation containing at least a silicon compound into contact with the surface of a soft magnetic metal powder 1, heating the powder for silicon impregnation to dissociate a silicon element from the silicon compound, and then diffusing the thus dissociated silicon element throughout the surface layer of the soft magnetic metal powder via impregnation; and silicon impregnation is performed under a diffusion atmosphere allowing dissociation where the reaction rate at which the silicon element is dissociated is higher than the diffusion rate at which the silicon element is diffused throughout the surface layer of the soft magnetic metal powder via impregnation.

4 Claims, 5 Drawing Sheets
(1 of 5 Drawing Sheet(s) Filed in Color)

POWDER FOR DUST CORE AND METHOD FOR PRODUCING THE SAME

CROSS REFERENCE TO RELATED APPLICATIONS

This application is a National Stage of International Application No. PCT/JP2009/057728 filed Apr. 17, 2009, claiming priority based on Japanese Patent Application No. 2008-109252 filed Apr. 18, 2008, the contents of all of which are incorporated herein by reference in their entirety.

TECHNICAL FIELD

The present invention relates to a powder for a dust core comprising a soft magnetic metal powder and a method for producing the same.

BACKGROUND ART

A dust core produced via pressure-forming of a powder for a dust core comprising a soft magnetic metal powder is applied to a stator core or a rotor core of a vehicle driving motor, a reactor core that constitutes a power inverter circuit, and the like. Unlike a core member composed via lamination of electromagnetic steel sheets, the dust core has many advantages such that: it has magnetic properties such as low high-frequency iron loss; it can be formed into a variety of shapes in a flexible manner at low cost; and the material cost is lower than those of alternatives.

Regarding the above-mentioned dust core, a measure exists to increase the specific resistance for reduction of iron loss, and particularly eddy loss, involving the preparation of an iron alloy of iron and silicon, aluminium, or the like as a soft magnetic metal powder, the formation of an insulating film of silica ($SiO_2$) or the like on the surface layer so as to prepare a magnetic powder, and the subsequent production of a dust core by pressure forming the magnetic powder. However, preparation of a magnetic powder using an iron alloy in which silicon, aluminium, or the like is homogeneously dispersed in an iron powder results in a problem such that the resulting hardness is excessively high and the realization of a high density for the dust core (produced via pressure forming thereof) is actually inhibited. If the density of the dust core cannot be increased, the magnetic flux density of the dust core cannot be increased. Therefore, it has been conventionally difficult to produce a dust core with high density, high specific resistance, and high magnetic flux density. A method that has been desired comprises infiltrating the surface layer of a soft magnetic metal powder with a silicon element or the like in an amount that results in as thin a state as is possible so as to enhance the specific resistance, and thus preparing a powder for a dust core in which no or an extremely small amount of a silicon element or the like is present.

For example, Patent document 1 discloses a method for producing a silicon layer-coated iron powder with a surface layer having a high concentration of silicon, which comprises mixing an iron powder subjected in advance to high temperature treatment and pulverization with a silicon powder and ferrosilicon and then performing high temperature treatment again in a hydrogen atmosphere.

Patent Document 1: JP Patent Publication (Kokai) No. 2007-126696 A

DISCLOSURE OF THE INVENTION

Objects to be Achieved by the Invention

According to the production method disclosed in Patent document 1, a silicon layer-coated iron powder with a surface layer having a high concentration of silicon can be produced. However, the present inventors verified the following facts. As shown in FIG. 7*a*, when the diameter of a powder particle "a" for a dust core comprising an iron powder "b" is designated as "D," it is specified that the thickness of the thus formed silicon layer "c" is greater than 0.2 D. In addition, the silicon concentration distribution in the silicon layer is as shown in FIG. 7*b*, such that the silicon concentration decreases in the direction from the powder surface layer toward the interior, presenting a gentle decline curve. According to the findings of the present inventors, an iron powder is sufficiently hard when the silicon layer has a thickness of greater than 0.2 D or 0.15 D or more under stricter conditions. It has thus been specified that it is difficult to sufficiently increase the density of a dust core.

The present invention has been achieved in view of the above problems. The present invention relates to a powder for a dust core wherein the surface layer of each particle of which contains a silicon-containing layer. An object of the present invention is to provide a method for producing a powder for a dust core, by which the aforementioned silicon-containing layer can be adjusted to have a thickness of less than 0.15 D when the particle diameter of a soft magnetic metal powder is designated as "D," and a powder for a dust core produced by the production method.

Means for Attaining the Object

In order to achieve the above objectives, the method for producing a powder for a dust core according to the present invention is a method for producing a powder for a dust core by performing silicon impregnation of the surface of a carbon-element-containing soft magnetic metal powder, whereby:

silicon impregnation is performed by bringing a powder (for silicon impregnation) containing at least a silicon compound into contact with the surface of a soft magnetic metal powder, heating the powder for silicon impregnation for dissociation of the silicon element from the silicon compound, and then causing the thus dissociated silicon element to diffuse throughout the surface layer of the soft magnetic metal powder via impregnation thereof; and silicon impregnation is performed under a diffusion atmosphere allowing dissociation where the reaction rate at which the silicon element is dissociated is higher than the diffusion rate at which the silicon element is diffused throughout the surface layer of the soft magnetic metal powder via impregnation thereof.

A powder for a dust core is prepared from a soft magnetic metal powder such as an iron-based powder containing a trace amount of a carbon element, for example. Examples of a soft magnetic metal powder to be used in the production method of the present invention include pure iron containing a trace amount of carbon, in addition to iron-carbon based alloys.

A layer containing a relatively high concentration of silicon is formed on the surface of a soft magnetic metal powder by bringing a powder for silicon impregnation containing at least a silicon compound into contact with the soft magnetic metal powder, followed by heat treatment. In addition, a powder for a dust core is prepared in which the interior of each particle of the soft magnetic metal powder is never impregnated, or is impregnated with an extremely low amount of silicon. Examples of such powder for silicon impregnation containing at least a silicon compound include silicon dioxide (silica) and a mixed powder comprising a silicon dioxide powder and a silicon carbide powder.

The present inventors have discovered that:

silicon is dissociated from a silicon compound not by a method that involves simply heating a silicon powder as in the previously described conventional art, but by heating a silicon compound powder on the surface of each particle of a soft magnetic metal powder, following which the dissociated silicon is diffused throughout the surface layer of the soft magnetic metal powder via silicon impregnation; and thus a layer containing a relatively high concentration of silicon is formed within a shallow depth from the surface of each particle of the soft magnetic metal powder. More specifically, the powder for silicon impregnation is heated, so as to perform an oxidation-reduction reaction of a carbon element that is a component in the soft magnetic metal powder with a powder for silicon impregnation, and then the thus prepared silicon element is diffused throughout the surface of the soft magnetic metal powder by silicon impregnation. In other words, a silicon element is substituted for a carbon element on the surface of a soft magnetic metal powder.

The present inventors have further discovered the following. When the surface layer of each particle of a soft magnetic metal powder has a given thickness, particularly the particle diameter of the soft magnetic metal powder is designated as "D," for example, and a silicon-containing layer is formed within a depth of less than 0.15 D from the surface, silicon impregnation is performed under a diffusion atmosphere allowing dissociation wherein the reaction rate at which a silicon element is dissociated is higher than the diffusion rate at which the silicon element is diffused throughout the surface layer of the soft magnetic metal powder via impregnation. In addition, the expression "the reaction rate is higher than the diffusion rate" refers to a situation in which the resulting amount of the reaction product is higher than the amount of diffused product. Therefore, the term "diffusion atmosphere allowing dissociation" may also refer to an atmosphere where the amount of the reaction product; that is, the amount of the silicon element dissociated, is higher than the amount of the silicon element diffused (the amount of the silicon element diffused throughout the surface layer of the soft magnetic metal powder via impregnation).

Examples of a factor for the formation of such diffusion atmosphere allowing dissociation of the conditions include adjustment (increasing the carbon content) of the carbon content in a soft magnetic metal powder, adjustment (increasing the silicon content or the like) of a silicon content (or the amount of a silicon compound) in a powder for silicon impregnation, adjustment of the temperature for heat treatment, refinement of a silicon compound powder (e.g., a powder with a particle diameter of 1 μm or less), an increase in the number of contacts between a carbon element and a silicon compound in association with refinement of the powder, adjustment of the degree of vacuum (increasing the degree of vacuum) within a heat treatment container, and adjustment (immediately performing exhaustion) of exhaust containing a carbonic acid gas generated by silicon impregnation.

Here, in an embodiment of the method for forming the above diffusion atmosphere allowing dissociation, an example of such atmosphere is characterized in that a soft magnetic metal powder comprises an iron-based powder, the above carbon element content in the soft magnetic metal powder is adjusted to range from 0.1% by weight to 1.0% by weight, and the above silicon element content (% by weight) in a silicon compound is adjusted to be at least the same as or higher than the carbon element content, and the temperature for heat treatment is adjusted to range from 900° C. to 1050° C.

First, regarding the temperature for heat treatment, the temperature range for heat treatment is defined since a temperature of less than 900° C. results in insufficient implementation of silicon impregnation and decreased efficiency of production of a powder for a dust core, and a temperature of higher than 1050° C. results in failure to establish an environment in which the reaction rate is higher than the diffusion rate.

Also, regarding the carbon element content in a soft magnetic metal powder, the range of the carbon element content is defined since a content of less than 0.1% by weight results in an insufficient amount of carbon substituted with a silicon element and difficulty forming a region having highly specific resistance to the surface layer of the soft magnetic metal powder, and a content of higher than 1.0% by weight results in lowered magnetic flux density of the soft magnetic metal powder itself.

Furthermore, the amount of silicon to be substituted for carbon is secured through adjustment of the silicon element content (% by weight) in the silicon compound such that it is at least the same or higher than the carbon element content.

Also, the powder for a dust core according to the present invention is a powder for a dust core that is produced by the above production method. The powder for a dust core comprises a soft magnetic metal powder that has a silicon-containing layer containing at least a silicon element on the surface, wherein:

when the average particle diameter of the soft magnetic metal powder is designated as "D," the silicon-containing layer is formed to a depth of less than 0.15 D from the surface of the soft magnetic metal powder and contains 1%-12% by weight silicon element; and the silicon-containing layer has a tendency to change in concentration such that the silicon concentration is highest at the surface, and it decreases from the surface toward the interior of the soft magnetic metal powder.

According to the verification made by the present inventors, the following has been demonstrated. A powder for a dust core prepared by the previously described production method of the present invention is characterized in that: a silicon-containing layer can be formed within an extremely shallow depth of less than 0.15 D from the surface (of the surface layer) of a soft magnetic metal powder (the diameter of each particle of which is designated as "D"); the silicon-containing layer contains 1%-12% by weight silicon element; and the silicon-containing layer has a tendency to change in silicon concentration such that the silicon concentration gradually decreases from the surface (of the surface layer) to the interior of the soft magnetic metal powder. Regarding the above depth range (represented by numerical figures), the silicon-containing layer is preferably formed within a depth of less than 0.1 D from the surface (of the surface layer) of the soft magnetic metal powder and 1%-10% by weight silicon element is contained in the silicon-containing layer. In addition, regarding the tendency to change in concentration, the change curve differs from that of a conventional example shown in FIG. 7*b* and presents a steep curve, such that the concentration falls steeply from the surface layer toward the center. Such tendency to change in concentration makes it possible to form a silicon-containing layer within a shallow depth of less than 0.15 D from the surface.

Here, when the silicon concentration in the surface layer is less than 1% by weight, an effect of reducing eddy loss cannot be sufficiently expected. Achieving a silicon concentration of higher than 10% by weight and more specifically 12% by weight or more is difficult. Hence, the above silicon concentration range in a silicon-containing layer is desired. Moreover, the above production method of the present invention makes it possible to form a silicon-containing layer with such silicon concentration range.

According to the above powder for a dust core of the present invention, a silicon-containing layer is formed, containing 1%-12% by weight silicon element to a shallow depth of less than 0.15 D from the surface (of the surface layer). Since the interior of a powder particle is in a state of containing no or an extremely low amount of the silicon element, a whole powder particle having high surface specific resistance and a degree of hardness causing no difficulties in high-density pressure forming can be prepared. Therefore, a dust core produced with the powder for a dust core has high magnetic flux density because of its high density and reduced eddy loss due to the silicon-containing surface layer.

The production of the above-mentioned high-performance dust core is appropriate for a stator core or a rotor core that constitutes a driving motor for hybrid vehicles or electric vehicles or a reactor core that constitutes a power converter, the production of which is rapidly increasing currently and the achievement of higher-performance of which is under research and development.

Effect of the Invention

As understood from the above explanation, according to the method for producing a powder for a dust core of the present invention, a powder for a dust core can be prepared having high surface specific resistance and entirely having a degree of hardness that causes no difficulties in achievement of high density at the time of pressure forming.

BRIEF DESCRIPTION OF THE DRAWINGS

The patent or application file contains at least one drawing executed in color. Copies of this patent or patent application publication with color drawings will be provided by the Office upon request and payment of the necessary fee.

FIG. 1(*b*) is a graph showing the silicon concentration distribution within the surface layer of the powder for a dust core.

FIG. 7 (*b*) shows a graph showing the silicon concentration distribution within the surface layer of the powder for a dust core.

EXPLANATION OF SYMBOLS

1: soft magnetic metal powder (iron-carbon based alloy); 2: silicon-containing layer; 10: powder for dust core

BEST MODE FOR CARRYING OUT THE INVENTION

Figure 1:
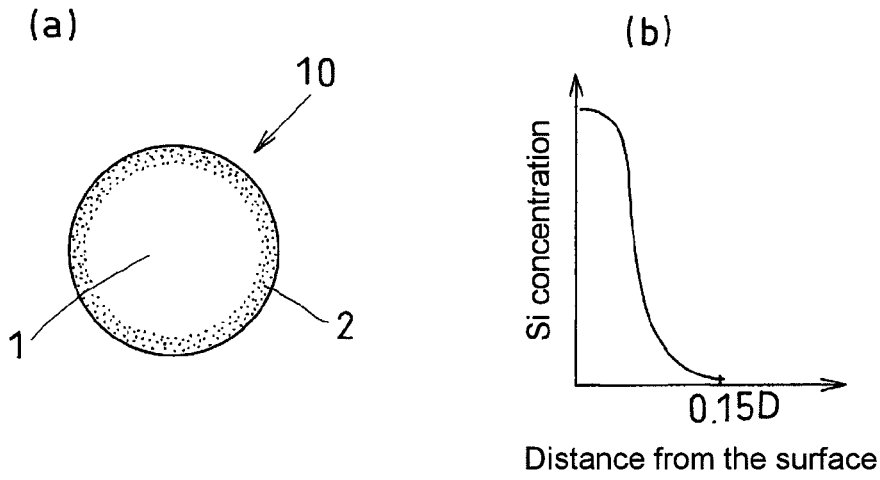
FIG. 1(*a*) schematically shows a powder for a dust core produced by the production method of the present invention.
Figure 2:
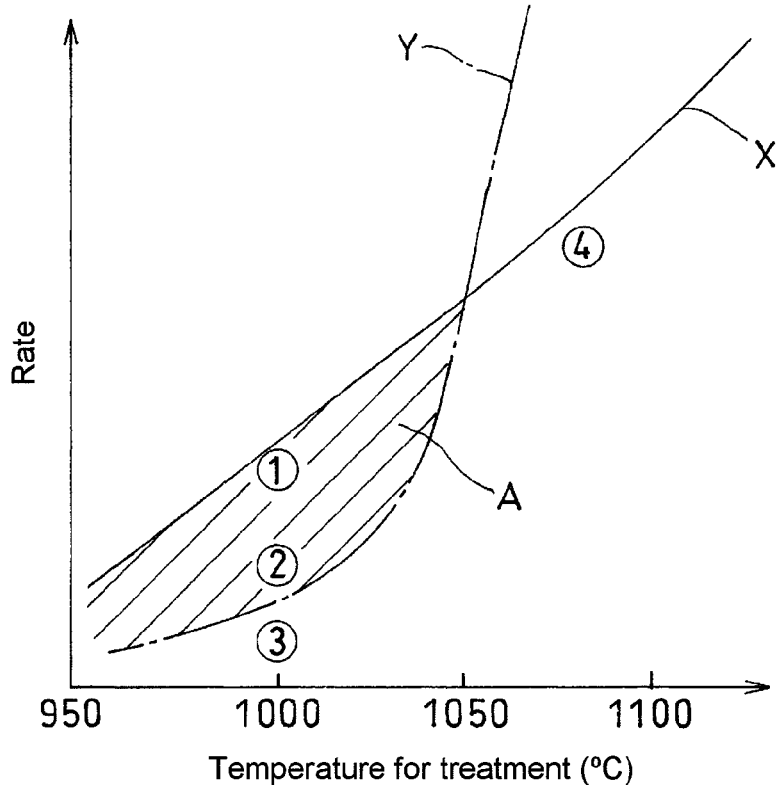
FIG. 2 shows the relationship among the temperature for treatment and a line representing the reaction rate of the silicon element (amount of reaction product) and a line representing the diffusion rate of the silicon element (amount of diffusion product).

Embodiments of the present invention will be described below with reference to the drawings. FIG. 1*a* schematically shows a powder for a dust core produced by the production method of the present invention. FIG. 1*b* is a graph showing the silicon concentration distribution within the surface layer of the powder for a dust core. FIG. 2 shows the relationship among the temperature for treatment and a line representing the reaction rate of the silicon element (amount of reaction product) and a line representing the diffusion rate of the silicon element (amount of diffusion product).

The powder for a dust core 10 of the present invention is formed of a soft magnetic metal powder 1 comprising a silicon-containing layer 2 formed within the surface layer and an iron-carbon based alloy (containing pure iron that contains a trace amount of carbon). The silicon-containing layer 2 is formed, when the diameter of a particle of the soft magnetic metal powder 1 is designated as "D," to a depth of less than 0.15 D from the surface of the surface layer. Through application of the production method of the present invention described later, a silicon-containing layer can be formed to have an even shallower depth of 0.05 D or less.

Also, the silicon concentration distribution within the silicon-containing layer 2, as shown in FIG. 1*b*, has a tendency to change such that: the silicon concentration is highest at the surface of each particle of a powder 10 (soft magnetic metal powder 1) and decreases toward the interior of the powder particle. More specifically, such tendency to change in concentration is represented by a steep curve as shown in FIG. 1*b* such that the concentration is extremely low at a depth of about 0.1 D.

Furthermore, the silicon-containing layer 2 contains a silicon element in an amount ranging from 1%-12% by weight. The silicon concentration is adjusted to within the range that depends on the level of desired specific resistance.

Next, the method for producing the powder for a dust core 10 is outlined as follows.

First, a soft magnetic metal powder comprising a given amount of an iron-carbon based alloy and silica (silicon compound) are prepared and then stirred.

Subsequently, to perform high-temperature treatment for silica, the thus stirred mixed powder is heated, an oxidation-reduction reaction with a carbon element in the soft magnetic metal powder is performed so as to dissociate the silicon element from silica, and then the silicon element is diffused throughout the surface layer of the soft magnetic metal powder via impregnation.

Such silicon impregnation is performed under a diffusion atmosphere allowing dissociation that is formed so that the reaction rate at which the silicon element is dissociated is higher than the diffusion rate at which the silicon element is diffused throughout the surface layer of the soft magnetic metal powder via impregnation.

FIG. 2 shows the relationship among the temperature for treatment and a line representing the reaction rate of the silicon element (amount of reaction product) and a line representing the diffusion rate of the silicon element (amount of diffusion product). In FIG. 2, line X indicates the reaction rate of the silicon element and line Y indicates the diffusion rate of the silicon element.

Each line shown herein was produced based on many experiments conducted by the present inventors. Values for the rate plotted along the vertical axis fluctuate depending on various conditions.

In FIG. 2, area A below line X and above line Y represents the above diffusion atmosphere allowing dissociation. Through setting of conditions represented by such area, the powder for a dust core 10 can be produced as shown in FIG. 1, for example.

According to the results of the experiments conducted by the present inventors, the temperature for treatment at which line X intersects with line Y is about 1050° C., and heat treatment is performed at this temperature or lower.

Also, the amounts of a carbon element in a soft magnetic metal powder and a silicon element in silica should be defined in accordance with other conditions for the formation of the above diffusion atmosphere allowing dissociation. According to the experiments conducted by the present inventors, the carbon element content in the soft magnetic metal powder ranged from 0.1% to 1.0% by weight. Through adjustment of the silicon element content in the silicon compound to a level (% by weight) at least the same as or higher than the carbon element content, a diffusion atmosphere allowing dissociation represented by area A can be formed at the above temperature conditions for treatment.

In addition, it is also preferred for the formation of the above diffusion atmosphere allowing dissociation that: the particle diameter of a silica powder be adjusted to 1 μm or less; silicon impregnation be performed within a vacuum chamber with a high degree of vacuum; and CO gas generated by the above oxidation-reduction reaction be immediately released outside of the chamber, for example.

After production of such powder for a dust core by the above production method, a cavity defined by a punch and a dice is charged with the powder, followed by press forming. Thus, a dust core in a desired shape can be produced.

[Experiments and Results Concerning the Magnetic Flux Density and Iron Loss for a Dust Core Formed with the Powder for a Dust Core of the Present Invention, and a Dust Core Formed with a Conventional Powder for a Dust Core]

The present inventors prepared a pure iron powder containing a trace amount of carbon, an Fe-3% Si alloy powder, an Fe-6.5% Si alloy powder (both powders being gas atomized powders with an average particle diameter ranging from 150 to 250 μm), and a silica powder. With the temperature for heat treatment upon silicon impregnation set to two levels (1000° C. and 1100° C.), silicon impregnation was performed. Thus, a plurality of types of powders for dust cores were prepared. Subsequently, a 0.5% by weight silicon resin was added to each type of powder and then a ring material with an outer diameter of 40 mm, an inner diameter of 30 mm, and a thickness of 5 mm was formed at a pressure of 1600 MPa. The thus formed ring material was heated at 600° C. for 30 minutes for strain removal upon pressure forming. Thus, a total of 6 test pieces were prepared in Examples 1 and 2 and Comparative examples 1-4.

Figure 3:
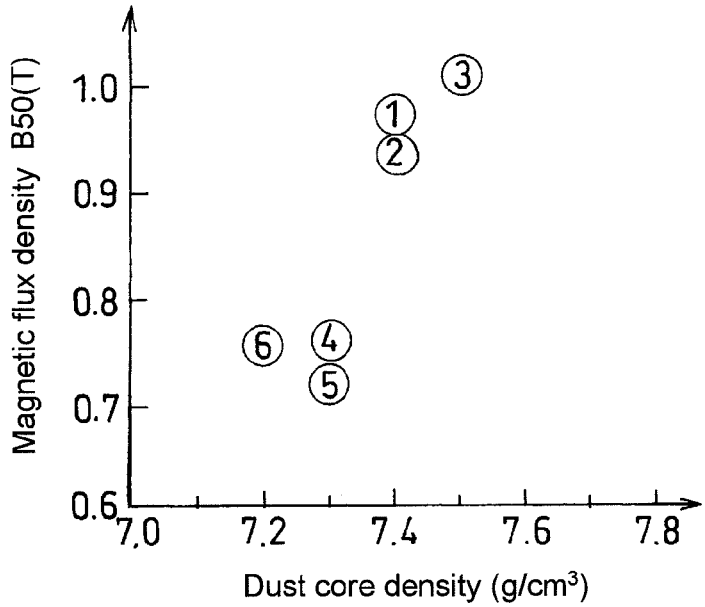
FIG. 3 shows experimental results concerning the magnetic flux densities of dust cores (Examples 1 and 2) formed with the powder for a dust core of the present invention and the magnetic flux densities of dust cores (Comparative examples 3, 4, 5, and 6) formed with a conventional powder for a dust core.
Figure 4:
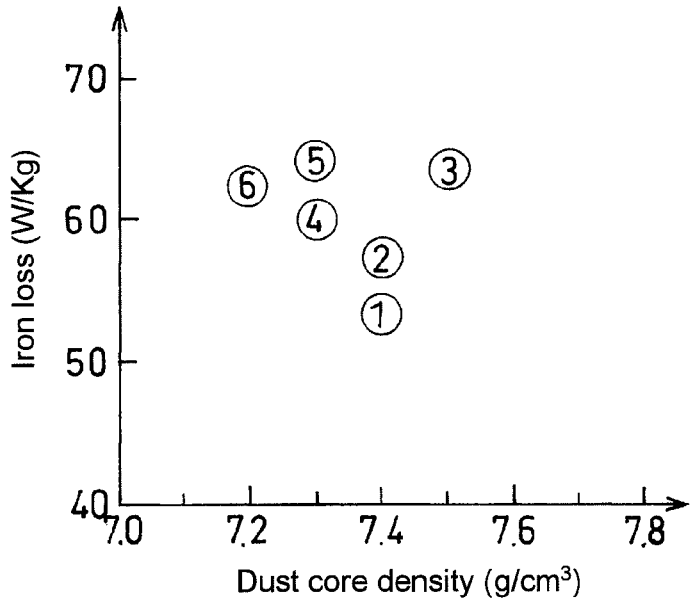
FIG. 4 shows experimental results concerning iron loss of dust cores (Examples 1 and 2) formed with the powder for a dust core of the present invention and iron loss of dust cores (Comparative examples 3-6) formed with a conventional powder for a dust core.
Figure 5:
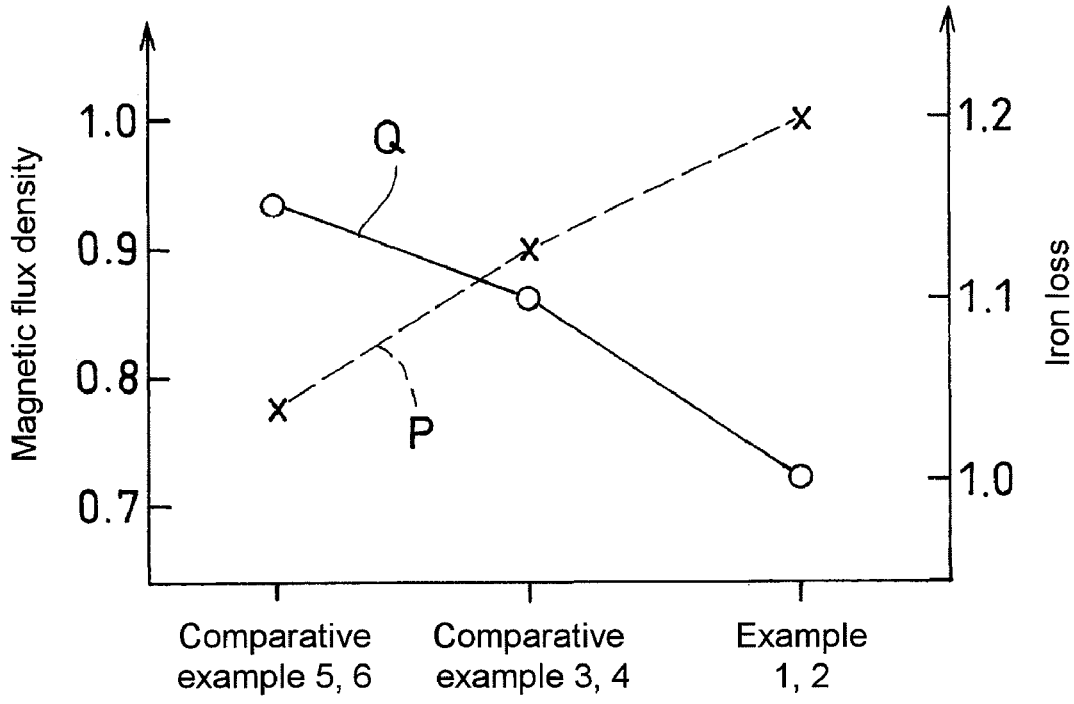
FIG. 5 shows a graph showing a summary of the experimental results concerning the magnetic flux densities and iron loss of the dust cores of Examples 1 and 2 and the dust cores of Comparative examples 3-6.

Table 1 shows a list of the production conditions for each test piece. Table 2 shows a list of the results concerning thickness and silicon concentration in silicon-containing layers of the thus produced powders for dust cores. FIG. 3 shows experimental results concerning the magnetic flux density of each test piece. FIG. 4 shows experimental results of experiments concerning iron loss. FIG. 5 shows a single graph showing experimental results concerning the magnetic flux density and iron loss in Examples and Comparative examples. In addition, magnetic flux density was measured using a B-H analyzer (Denshijiki Industry Co., Ltd.). Iron loss was measured using a B-H analyzer (Iwatsu Electric Co., Ltd.: SY-8232). Measurement was performed under conditions of 1 T and 1 kHz.

TABLE 1

| | Soft magnetic metal powder | Carbon amount (% by weight) | Silica amount (% by weight) | Temperature for treatment (° C.) | Time for treatment (min) |
|---|---|---|---|---|---|
| Example 1 | Pure iron powder | 0.3 | 15 | 1000 | 60 |
| Example 2 | Pure iron powder | 0.4 | 8 | 1000 | 120 |
| Comparative example 3 | Pure iron powder | 0.09 | 3 | 1000 | 60 |
| Comparative example 4 | Pure iron powder | 0.9 | 10 | 1100 | 120 |
| Comparative example 5 | Fe—3% Si alloy powder | — | — | — | — |
| Comparative example 6 | Fe—6.5% Si alloy powder | — | — | — | — |

TABLE 2

| | Si concentration in silicon-containing layer (% by weight) | Impregnation depth (metal powder particle diameter: D) | Si concentration in the central portion (% by weight) |
|---|---|---|---|
| Example 1 | 10 | 0.03 D | Measurement accuracy or less |
| Example 2 | 3 | 0.03 D | Measurement accuracy or less |
| Comparative example 3 | 0.5 | 0.05 D | Measurement accuracy or less |
| Comparative example 4 | 3 | 0.15 D | Measurement accuracy or less |
| Comparative example 5 | 3 | — | 3 |
| Comparative example 6 | 6.5 | — | 6.5 |

In Table 1, the test pieces in Comparative examples 5 and 6 contain silicon in a homogenous state within the alloy powder particles, which differ from powder particles (in Examples 1 and 2 and Comparative examples 3 and 4) comprising silicon-containing layers alone in surface layers. In addition, "1, 2, 3, and 4" in the graph shown in FIG. 2 correspond to Example 1, Example 2, Comparative example 2, and Comparative example 4, respectively.

The times for treatment were set at 60 minutes and 120 minutes. This was determined based on the findings of the present inventors, such that the reaction rate of silica remains on an upward trend until at least 120 minutes (after the start of the following reaction) when a silica powder is reacted with a pure iron powder containing a trace amount of a carbon element. The time for treatment was lengthened to a point in time at which the reaction rate began to fall (showing a downward trend), resulting in an unnecessary lengthy time for treatment. This is also unfavorable in terms of production efficiency. The time range during which the reaction rate remains on an upward trend varies depending on the combination of soft magnetic metal powder and silicon compound to be used. Hence, the time for reaction appropriate for such combination should be determined.

As a result of such experiments, through setting the amount of carbon at 0.3% by weight and 0.4% by weight (within a range of 0.1%-1.0% by weight) in Examples 1 and 2, respectively, the amount of silica (silicon element therein) at the same level as or higher than the amount of carbon, and the temperature for treatment at 1000° C. within a range of 900-1050° C., a 10.3% by weight powder for a dust core could be produced as shown in Table 2, wherein the depth of impregnation (silicon-containing layer thickness) was 0.03 D (less than 0.15 D) and the silicon content in the silicon-containing layer ranged from 1% by weight to 12% by weight. In contrast, the results of Comparative examples 3 and 4 failed to satisfy the conditions for either the silicon concentration in the silicon-containing layer or the depth of impregnation.

Also, the results of measuring magnetic properties (magnetic flux density) shown in FIG. 3 indicate that the dust core densities in Examples 1 and 2 and Comparative example 3 were relatively high (The silicon-containing layer was relatively thin and the hardness of the thus prepared powder for a dust core was relatively low.). It was thus demonstrated that the magnetic flux density was increased as a result. Moreover, the magnetic flux densities in Examples 1 and 2 and Comparative example 3 were each higher by about 30% than the same for Comparative examples 4, 5, and 6.

Meanwhile, as with the results of measuring iron loss shown in FIG. 4, iron loss was low in Examples 1 and 2 and Comparative example 4, wherein the silicon concentration in the silicon-containing layer was relatively high. In particular, the effects of reducing iron loss in Examples 1 and 2 were significant.

FIG. 5 shows a single graph showing experimental results concerning the magnetic flux density and iron loss of the dust cores of Examples 1 and 2 and the dust cores of Comparative examples 3-6 above. In FIG. 5, line P indicates magnetic flux density and line Q indicates iron loss.

As is understood from FIG. 5, the dust cores of Examples 1 and 2 had magnetic flux densities higher than and iron loss lower than the same of the dust cores of Comparative examples 3-6. In particular, the magnetic flux densities in Examples 1 and 2 were each higher by about 30% than the same in Comparative examples 5 and 6, but iron loss in Examples 1 and 2 was lower by about 15% than the same in Comparative examples 5 and 6.

Figure 6:
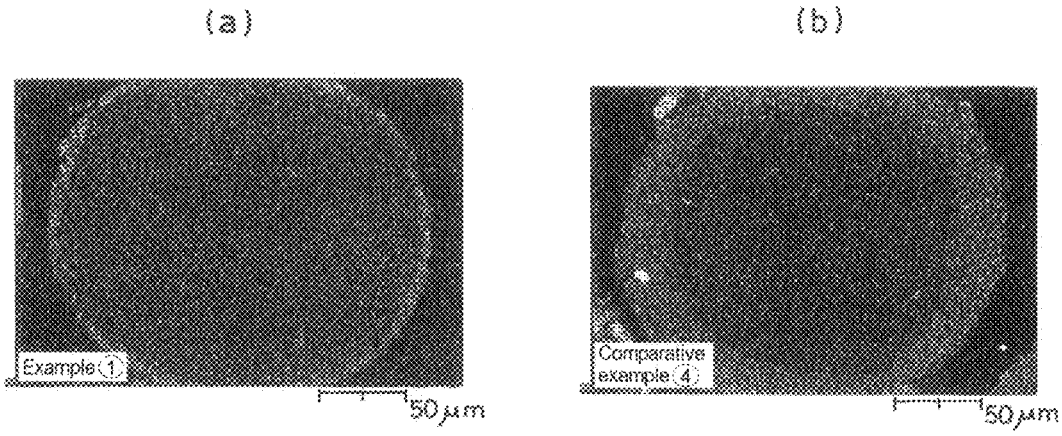
FIG. 6(*a*) shows an SEM-EDX image from Example 1 above and FIG. 6(*b*) shows an SEM-EDX image from Comparative example 4 above.
Figure 7:
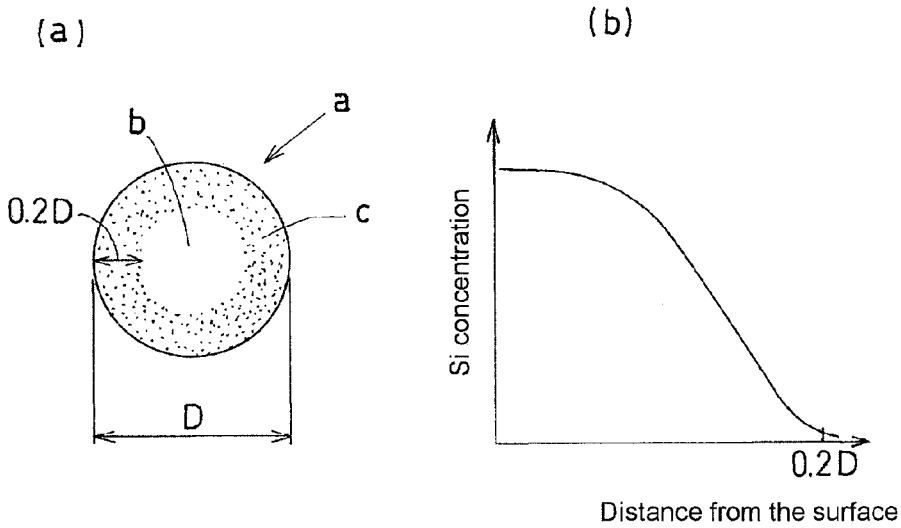
FIG. 7 PRIOR ART
FIG. 7(*a*) schematically shows a conventional powder for a dust core.

Also, FIG. 6*a* shows an SEM-EDX image of the powder for dust core formation of Example 1. FIG. 6*b* shows an SEM-EDX image of the powder for dust core formation of Comparative example 4.

FIGS. 6*a* and *b* show silicon-containing layers formed in the powder surface layers. As are understood from FIGS. 6*a* and *b*, the thin silicon-containing layer of 0.03 D was formed in Example 1 and the relatively thick silicon-containing layer of 0.15 D was formed in Comparative example 4.

Embodiments of the present invention are specifically described above with reference to the drawings. However, the specific constitution of the present invention is not limited to the embodiments. Therefore, the present invention encompasses any design changes or the like that do not depart from the spirit of the present invention.

The invention claimed is:

1. A method for producing a powder for a dust core, comprising performing silicon impregnation of the surface of a soft magnetic metal powder containing a carbon element, wherein:

silicon impregnation is performed by bringing a powder for silicon impregnation containing at least a silicon compound into contact with the surface of a soft magnetic metal powder comprising an iron-based powder, heating the powder for silicon impregnation to dissociate a silicon element from the silicon compound, and then diffusing the thus dissociated silicon element throughout the surface layer of the soft magnetic metal powder via impregnation;

silicon impregnation is performed under a diffusion atmosphere allowing dissociation where the reaction rate at which the silicon element is dissociated is higher than the diffusion rate at which the silicon element is diffused throughout the surface layer of the soft magnetic metal powder via impregnation; and the diffusion atmosphere allowing dissociation is formed by adjusting the carbon element content in the soft magnetic metal powder to range from 0.1% by weight to 1.0% by weight, adjusting the silicon element content (% by weight) in a silicon compound to be at least the same as or higher than the carbon element content, and adjusting the temperature for heat treatment to range from 900° C. to 1050° C.

2. The method for producing a powder for a dust core according to claim 1, wherein the powder for silicon impregnation comprises a powder containing at least silicon dioxide.

3. A powder for a dust core, which is produced by the production method according to claim 1, wherein:

the powder for the dust core comprises a soft magnetic metal powder having a silicon-containing layer that contains at least a silicon element on its surface;

when the average particle diameter of the soft magnetic metal powder is designated as "D," the silicon-containing layer is formed within a depth of less than 0.15 D from the surface of each particle of the soft magnetic metal powder and contains a silicon element in an amount ranging from 1% by weight to 12% by weight; and the silicon-containing layer has a tendency to change in silicon concentration such that the silicon concentration at the surface is highest and gradually decreases from the surface toward the interior of the soft magnetic metal powder.

4. A powder for a dust core, which is produced by the production method according to claim 2, wherein:

the powder for the dust core comprises a soft magnetic metal powder having a silicon-containing layer that contains at least a silicon element on its surface;

when the average particle diameter of the soft magnetic metal powder is designated as "D," the silicon-containing layer is formed within a depth of less than 0.15 D from the surface of each particle of the soft magnetic metal powder and contains a silicon element in an amount ranging from 1% by weight to 12% by weight; and the silicon-containing layer has a tendency to change in silicon concentration such that the silicon concentration at the surface is highest and gradually decreases from the surface toward the interior of the soft magnetic metal powder.

* * * * *